United States Patent [19]

Habib

[11] Patent Number: 4,813,707

[45] Date of Patent: Mar. 21, 1989

[54] PERPETUAL CALENDAR

[76] Inventor: Mohammed K. Habib, P.O. Box 10775, DuBai, United Arab Emirates

[21] Appl. No.: 167,021

[22] Filed: Mar. 11, 1988

[51] Int. Cl.[4] ..... B42D 15/00

[52] U.S. Cl. ..... 253/2

[58] Field of Search ..... 283/2, 1 R, 60 R

[56] References Cited

U.S. PATENT DOCUMENTS

| | | | |
|---|---|---|---|
| 458,970 | 9/1891 | Fitch | 283/2 |
| 505,901 | 10/1893 | Hoyt | 283/2 |
| 773,669 | 11/1904 | O'Shaugnessy | 283/2 |
| 789,166 | 5/1905 | Manfred | 283/2 |
| 1,016,370 | 2/1912 | Singh | 283/2 |
| 1,153,926 | 9/1915 | Johnston | 283/2 |
| 1,374,532 | 4/1921 | Spillman | 283/2 |
| 1,608,411 | 11/1926 | Mateju | 283/2 |
| 2,768,459 | 10/1956 | Corbett | 283/2 X |
| 4,251,935 | 2/1981 | Wright | 283/2 X |
| 4,285,148 | 8/1981 | Kolar | 283/2 X |

*Primary Examiner*—Paul A. Bell

*Attorney, Agent, or Firm*—F. R. Hirtler

[57] ABSTRACT

A perpetual calendar comprising a plurality of tables containing basic data for the determination of the day of the week for dates of the Gregorian, Julian, Islamic, Zodiacal and Coptic calendars using minimal calculations and notes and being applicable essentially limitless.

4 Claims, 2 Drawing Sheets

| A | 0 | 1 | 2 | 3 | B | 0 | 1 | 2 | 3 | C | 0 | 1 | 2 | 3 | D | 0 | 1 | 2 | 3 | ST | | | LP | | | HJ | | ZO | | CP | | E | 1 | 2 | 3 | 4 | 5 | 6 | 7 |
|---|---|---|---|---|---|---|---|---|---|---|---|---|---|---|---|---|---|---|---|---|---|---|---|---|---|---|---|---|---|---|---|---|---|---|---|---|---|---|---|
| 1 | 3 | 2 | 7 | 5 | 2 | 4 | 3 | 1 | 6 | 3 | 5 | 4 | 2 | 7 | 4 | 6 | 5 | 3 | 1 | 1 | 10 | - | 1 | 4 | 7 | 1 | 10 | 1 | 12 | 1 | 8 | 1 | 1 | 2 | 3 | 4 | 5 | 6 | 7 |
| 5 | 1 | 7 | 5 | 3 | 6 | 2 | 1 | 6 | 4 | 7 | 3 | 2 | 7 | 5 | 8 | 4 | 3 | 1 | 6 | 5 | - | - | 10 | - | - | 6 | 11 | 6 | 9 | 5 | 12 | 2 | 2 | 3 | 4 | 5 | 6 | 7 | 1 |
| 9 | 6 | 5 | 3 | 1 | 10 | 7 | 6 | 4 | 2 | 11 | 1 | 7 | 5 | 3 | 12 | 2 | 1 | 6 | 4 | 8 | - | - | 5 | - | - | 2 | 7 | 4 | - | 2 | 9 | 3 | 3 | 4 | 5 | 6 | 7 | 1 | 2 |
| 13 | 4 | 3 | 1 | 6 | 14 | 5 | 4 | 2 | 7 | 15 | 6 | 5 | 3 | 1 | 16 | 7 | 6 | 4 | 2 | 2 | 3 | 11 | 2 | 8 | - | 3 | 12 | 2 | 10 | 6 | 13 | 4 | 4 | 5 | 6 | 7 | 1 | 2 | 3 |
| 17 | 2 | 1 | 6 | 4 | 18 | 3 | 2 | 7 | 5 | 19 | 4 | 3 | 1 | 6 | 20 | 5 | 4 | 2 | 7 | 6 | - | - | 3 | 11 | - | 8 | - | 7 | - | 3 | 10 | 5 | 5 | 6 | 7 | 1 | 2 | 3 | 4 |
| 21 | 7 | 6 | 4 | 2 | 22 | 1 | 7 | 5 | 3 | 23 | 2 | 1 | 6 | 4 | 24 | 3 | 2 | 7 | 5 | 9 | 12 | - | 6 | - | - | 4 | 9 | 5 | 11 | 7 | - | 6 | 6 | 7 | 1 | 2 | 3 | 4 | 5 |
| 25 | 5 | 4 | 2 | 7 | 26 | 6 | 5 | 3 | 1 | 27 | 7 | 6 | 4 | 2 | 28 | 1 | 7 | 5 | 3 | 4 | 7 | - | 9 | 12 | - | 5 | - | 3 | 8 | 4 | 11 | 7 | 7 | 1 | 2 | 3 | 4 | 5 | 6 |

| A | 0 | 1 | 2 | 3 | B | 0 | 1 | 2 | 3 | C | 0 | 1 | 2 | 3 | D | 0 | 1 | 2 | 3 | ST | | | LP | | | HJ | | ZO | | CP | | E | 1 | 2 | 3 | 4 | 5 | 6 | 7 |
|---|---|---|---|---|---|---|---|---|---|---|---|---|---|---|---|---|---|---|---|---|---|---|---|---|---|---|---|---|---|---|---|---|---|---|---|---|---|---|---|
| 1 | 3 | 2 | 7 | 5 | 2 | 4 | 3 | 1 | 6 | 3 | 5 | 4 | 2 | 7 | 4 | 6 | 5 | 3 | 1 | 1 | 10 | - | 1 | 4 | 7 | 1 | 10 | 1 | 12 | 1 | 8 | 1 | 1 | 2 | 3 | 4 | 5 | 6 | 7 |
| 5 | 1 | 7 | 5 | 3 | 6 | 2 | 1 | 6 | 4 | 7 | 3 | 2 | 7 | 5 | 8 | 4 | 3 | 1 | 6 | 5 | - | - | 10 | - | - | 6 | 11 | 6 | 9 | 5 | 12 | 2 | 2 | 3 | 4 | 5 | 6 | 7 | 1 |
| 9 | 6 | 5 | 3 | 1 | 10 | 7 | 6 | 4 | 2 | 11 | 1 | 7 | 5 | 3 | 12 | 2 | 1 | 6 | 4 | 8 | - | - | 5 | - | - | 2 | 7 | 4 | - | 2 | 9 | 3 | 3 | 4 | 5 | 6 | 7 | 1 | 2 |
| 13 | 4 | 3 | 1 | 6 | 14 | 5 | 4 | 2 | 7 | 15 | 6 | 5 | 3 | 1 | 16 | 7 | 6 | 4 | 2 | 2 | 3 | 11 | 2 | 8 | - | 3 | 12 | 2 | 10 | 6 | 13 | 4 | 4 | 5 | 6 | 7 | 1 | 2 | 3 |
| 17 | 2 | 1 | 6 | 4 | 18 | 3 | 2 | 7 | 5 | 19 | 4 | 3 | 1 | 6 | 20 | 5 | 4 | 2 | 7 | 6 | - | - | 3 | 11 | - | 8 | - | 7 | - | 3 | 10 | 5 | 5 | 6 | 7 | 1 | 2 | 3 | 4 |
| 21 | 7 | 6 | 4 | 2 | 22 | 1 | 7 | 5 | 3 | 23 | 2 | 1 | 6 | 4 | 24 | 3 | 2 | 7 | 5 | 9 | 12 | - | 6 | - | - | 4 | 9 | 5 | 11 | 7 | - | 6 | 6 | 7 | 1 | 2 | 3 | 4 | 5 |
| 25 | 5 | 4 | 2 | 7 | 26 | 6 | 5 | 3 | 1 | 27 | 7 | 6 | 4 | 2 | 28 | 1 | 7 | 5 | 3 | 4 | 7 | - | 9 | 12 | - | 5 | - | 3 | 8 | 4 | 11 | 7 | 7 | 1 | 2 | 3 | 4 | 5 | 6 |

FIG-1

| F | 0 | 1 | 2 | 3 | G | 0 | 1 | 2 | 3 | I | 0 | 1 | 2 | 3 | J | 0 | 1 | 2 | 3 |
|---|---|---|---|---|---|---|---|---|---|---|---|---|---|---|---|---|---|---|---|
| 1 | 4 | 5 | 7 | 2 | 2 | 3 | 4 | 6 | 1 | 3 | 2 | 3 | 5 | 7 | 4 | 1 | 2 | 4 | 6 |
| 5 | 6 | 7 | 2 | 4 | 6 | 5 | 6 | 1 | 3 | 7 | 4 | 5 | 7 | 2 | 8 | 3 | 4 | 6 | 1 |
| 9 | 1 | 2 | 4 | 6 | 10 | 7 | 1 | 3 | 5 | 11 | 6 | 7 | 2 | 4 | 12 | 5 | 6 | 1 | 3 |
| 13 | 3 | 4 | 6 | 1 | 14 | 2 | 3 | 5 | 7 | 15 | 1 | 2 | 4 | 6 | 16 | 7 | 1 | 3 | 5 |
| 17 | 5 | 6 | 1 | 3 | 18 | 4 | 5 | 7 | 2 | 19 | 3 | 4 | 6 | 1 | 20 | 2 | 3 | 5 | 7 |
| 21 | 7 | 1 | 3 | 5 | 22 | 6 | 7 | 2 | 4 | 23 | 5 | 6 | 1 | 3 | 24 | 4 | 5 | 7 | 2 |
| 25 | 2 | 3 | 5 | 7 | 26 | 1 | 2 | 4 | 6 | 27 | 7 | 1 | 3 | 5 | 28 | 6 | 7 | 2 | 4 |

FIG-2

| AD | | | | 0 | 2 | 4 | 6 | 1 | 3 | 5 | 0 | 1 | 2 | 3 |
|---|---|---|---|---|---|---|---|---|---|---|---|---|---|---|
| 0 | 1 | 2 | 3 | 0 | 5 | 3 | 1 | 6 | 4 | 2 | BC | | | |
| 3 | 2 | 7 | 5 | 1 | 5 | 9 | 13 | 17 | 21 | 25 | 4 | 5 | 7 | 2 |
| 4 | 3 | 1 | 6 | 2 | 6 | 10 | 14 | 18 | 22 | 26 | 3 | 4 | 6 | 1 |
| 5 | 4 | 2 | 7 | 3 | 7 | 11 | 15 | 19 | 23 | 27 | 2 | 3 | 5 | 7 |
| 6 | 5 | 3 | 1 | 4 | 8 | 12 | 16 | 20 | 24 | 28 | 1 | 2 | 4 | 6 |

FIG-4

| L | 0 | 1 | 2 | 3 | 4 | 5 | 6 | N | 0 | 1 | 2 | 3 | 4 | 5 | 6 | P | 0 | 1 | 2 | 3 | 4 | 5 | 6 | Q | 0 | 1 | 2 | 3 | 4 | 5 | 6 |
|---|---|---|---|---|---|---|---|---|---|---|---|---|---|---|---|---|---|---|---|---|---|---|---|---|---|---|---|---|---|---|---|
| 1 | 1 | 7 | 6 | 5 | 4 | 3 | 2 | 2 | 2 | 1 | 7 | 6 | 5 | 4 | 3 | 3 | 3 | 2 | 1 | 7 | 6 | 5 | 4 | 4 | 4 | 3 | 2 | 1 | 7 | 6 | 5 |
| 5 | 6 | 5 | 4 | 3 | 2 | 1 | 7 | 6 | 7 | 6 | 5 | 4 | 3 | 2 | 1 | 7 | 1 | 7 | 6 | 5 | 4 | 3 | 2 | 8 | 2 | 1 | 7 | 6 | 5 | 4 | 3 |
| 9 | 4 | 3 | 2 | 1 | 7 | 6 | 5 | 10 | 5 | 4 | 3 | 2 | 1 | 7 | 6 | 11 | 6 | 5 | 4 | 3 | 2 | 1 | 7 | 12 | 7 | 6 | 5 | 4 | 3 | 2 | 1 |
| 13 | 2 | 1 | 7 | 6 | 5 | 4 | 3 | 14 | 3 | 2 | 1 | 7 | 6 | 5 | 4 | 15 | 4 | 3 | 2 | 1 | 7 | 6 | 5 | 16 | 5 | 4 | 3 | 2 | 1 | 7 | 6 |
| 17 | 7 | 6 | 5 | 4 | 3 | 2 | 1 | 18 | 1 | 7 | 6 | 5 | 4 | 3 | 2 | 19 | 2 | 1 | 7 | 6 | 5 | 4 | 3 | 20 | 3 | 2 | 1 | 7 | 6 | 5 | 4 |
| 21 | 5 | 4 | 3 | 2 | 1 | 7 | 6 | 22 | 6 | 5 | 4 | 3 | 2 | 1 | 7 | 23 | 7 | 6 | 5 | 4 | 3 | 2 | 1 | 24 | 1 | 7 | 6 | 5 | 4 | 3 | 2 |
| 25 | 3 | 2 | 1 | 7 | 6 | 5 | 4 | 26 | 4 | 3 | 2 | 1 | 7 | 6 | 5 | 27 | 5 | 4 | 3 | 2 | 1 | 7 | 6 | 28 | 6 | 5 | 4 | 3 | 2 | 1 | 7 |

FIG-3

| Y' | | | | | | | | | | | | | M | | K | | H | |
|---|---|---|---|---|---|---|---|---|---|---|---|---|---|---|---|---|---|---|
| 1• | 9• | 17• | 25 | 33 | 41 | 49 | 57 | 65* | 73* | 81* | 89* | 97* | 5 | 4* | 7 | 1• | 3 | – |
| 2° | 10° | 18° | 26 | 34 | 42 | 50 | 58 | 66• | 74• | 82• | 90• | 98• | 2 | – | 5 | 4• | 7 | 1° |
| 3* | 11* | 19* | 27* | 35 | 43 | 51 | 59 | 67 | 75° | 83° | 91° | 99° | 6 | 7* | 2 | – | 5 | 4° |
| 4• | 12• | 20• | 28• | 36 | 44 | 52 | 60 | 68 | 76* | 84* | 92* | 100* | 4 | 3* | 6 | 7• | 2 | – |
| 5° | 13° | 21° | 29° | 37° | 45 | 53 | 61 | 69 | 77 | 85• | 93• | – | 1 | – | 4 | 3• | 6 | 7° |
| 6* | 14* | 22* | 30* | 38* | 46 | 54 | 62 | 70 | 78 | 86° | 94° | – | 5 | 6* | 1 | – | 4 | 3° |
| 7° | 15 | 23 | 31 | 39 | 47 | 55• | 63• | 71• | 79• | 87• | 95* | – | 3 | 2* | 6 | 5• | 1 | 2° |
| 8*° | 16° | 24° | 32° | 40° | 48° | 56 | 64 | 72 | 80 | 88 | 96• | – | 7 | 1* | 3 | 2• | 5 | 6° |

FIG-5

| M | K | H | T | U |
|---|---|---|---|---|
| 1 | 2 | 3 | 0 | 0 |
| 4 | 5 | 6 | +1 | -1 |
| 7 | 8 | 9 | +2 | -2 |
| 10 | 11 | 12 | +3 | -3 |
| 13 | 14 | 15 | +4 | -4 |
| 16 | 17 | 18 | +5 | -5 |
| 19 | 20 | 21 | +6 | -6 |

FIG-7

| X | Y | Z | Y' | Z' |
|---|---|---|---|---|
| 1 | 5 | 8 | 1 | 14 |
| 2 | 2 | 13 | 3 | 4 |
| 3 | 7 | 4 | 6 | 10 |
| 4 | 4 | 9 | 2 | 15 |
| 5 | 1 | 15 | 4 | 6 |
| 6 | 6 | 5 | 7 | 11 |
| 7 | 3 | 11 | 2 | 2 |
| 8 | 1 | 1 | 5 | 7 |

FIG-9

| Y2 | | | | | | | | | | | | | M | | K | | H | |
|---|---|---|---|---|---|---|---|---|---|---|---|---|---|---|---|---|---|---|
| 1° | 9° | 17° | 25° | 33 | 41 | 49 | 57 | 65 | 73• | 81• | 89• | 97• | 1 | – | 5 | 6• | 3 | 2° |
| 2* | 10* | 18* | 26* | 34 | 42 | 50 | 58 | 66 | 74° | 82° | 90° | 98° | 4 | 3* | 1 | – | 5 | 6° |
| 3• | 11• | 19• | 27• | 35• | 43 | 51 | 59 | 67 | 75 | 83* | 91* | 99* | 6 | 7* | 4 | 3• | 1 | – |
| 4° | 12° | 20° | 28° | 36° | 44 | 52 | 60 | 68 | 76 | 84• | 92• | 100• | 2 | – | 6 | 7• | 4 | 3° |
| *5• | 13* | 21* | 29* | 37* | 45* | 53 | 61 | 69 | 77 | 85 | 93° | – | 5 | 4* | 2 | 1• | 6 | 7° |
| •6° | 14• | 22• | 30• | 38• | 46• | 54 | 62 | 70 | 78 | 86 | 94* | – | 7 | 1* | 5 | 4• | 2 | 1° |
| 7* | 15* | 23 | 31 | 39 | 47 | 55 | 63° | 71° | 79° | 87° | 95° | – | 3 | 2* | 7 | – | 4 | 5° |
| 8• | 16• | 24 | 32 | 40 | 48 | 56 | 64* | 72* | 80* | 88* | 96* | – | 5 | 6* | 3 | 2• | 7 | – |

FIG-6

| S | DAY OF THE WEEK |
|---|---|
| 1 | SUNDAY |
| 2 | MONDAY |
| 3 | TUESDAY |
| 4 | WEDNESDAY |
| 5 | THURSDAY |
| 6 | FRIDAY |
| 7 | SATURDAY |

FIG-8

PERPETUAL CALENDAR

BACKGROUND OF THE INVENTION

This invention deals with perpetual calendar means which allow the user to determine the day of the week of any date requiring only minimal calculations while dealing with a few simple tables. Such determination may be undertaken for the modern Gregorian calendar as well as for the Julian, Islamic, Coptic or Zodiacal calendars.

Many so-called perpetual calendar schemes have been proposed in the past, however, such calendars usually include numerous and cumbersome tables or complicated calculations or combinations thereof. Typical calendar systems may be found in the references of interest discussed below, namely U.S. Pat. No. 505,901 Oct. 3, 1893 (Hoyt) describes a calendar with rather large and confusing tables covering only a limited number of years.

U.S. Pat. No. 773,669 Nov. 1, 1904 (O'Shaughnessy) teaches a perpetual calendar requiring five large tables with an array of numerals and names of months and days in a color scheme arranged in a confusing manner.

U.S. Pat. No. 1,016,370 Feb. 6, 1912 (Singh) discloses a circular calendar using numbers arranged in a seemingly irregular fashion and color schemes. Although it encompasses the Gregorian and Julian calendars, no provisions are made for dates before B.C. or for Coptic, Islamic or Zodiacal calendars.

U.S. Pat. No. 1,374,532 Apr. 12, 1921 (Spillman) deals with a perpetual calendar applicable to the Julian and Gregorian systems, however, this calendar is limited to a time span from the 16th to the 20th century. No mention is made of Coptic, Islamic etc. calendars.

U.S. Pat. No. 1,608,411 Nov. 23, 1926 (Mateju) is concerned with a perpetual Gregorian calendar having cumbersome charts with a multiplicity of numbers in different colors running from 0 to 99. Julian, Islamic and other calendar notations cannot be determined.

Other background references of interest include U.S. Pat. Nos. 458,970 (Fitch); 789,166 (Manfred); 1,153,926 (Johnston); 2,588,795 (Bauer); 2,768,459 (Corbett); 2,788,595 (Edwards); 3,698,113 (Spicer); 3,792,541 (Engle); 3,936,966 (Zeiske); 4,251,935 (Wright); 4,285,147 and 4,285,148 (Kolar); 4,381,614 (Kebe) and 4,472,893 (Curti).

None of these references provide a date determining means and method as comprehensive yet facile to use as the instant invention.

SUMMARY OF THE INVENTION

It is the object of this invention to provide a calendar means enabling the user to determine the day of the week of any date according to the Gregorian calendar, before or after Christ.

It is another object of this invention to allow determination of days of certain dates according to the Julian calendar system;

It is a further object of this invention to provide means for determining days of dates according to the Islamic calendar;

It is still another object of this invention to provide means for establishing days of dates according to the Coptic and Zodiacal calendars;

It is still a further object of this invention to determine dates for feasts such as Ramadan, Easter, Ash Wednesday and the like according to Gregorian, Julian, Islamic, Coptic and Zodiacal calendars;

Other objects of this invention shall become apparent by the specification and claims.

BRIEF DESCRIPTION OF DRAWINGS

FIG. 1 provides a table for evaluation calendar data according to the Gregorian calendar, A.D. (anno domini);

FIG. 2 represents a table for establishing the key of a year according to the Gregorian calendar, B.C. (before Christ);

FIG. 3 is a table value useful for determining the key of the year according to the Julian calendar;

FIG. 4 represents a simplified table of values for determining calendar information in accordance with the Gregorian calendar, B.C. or A.D.;

FIG. 5 represents a table of numbers suitable for determining calendar data after the so-called Hijrah (Hegira) according to the Islamic (lunar) calendar;

FIG. 6 represents a table of numbers useful for determining calendar data before Hijrah according to the lunar calendar;

FIG. 7 is a table for determining so-called century values for use of the lunar calendars of FIGS. 5 and 6;

FIG. 8 correlates numerical day values with names of days of the week as used herein.

FIG. 9 represents a tabulation of values associated with an abbreviated form of the Islamic calendar according to this invention.

DESCRIPTION OF THE PREFERRED EMBODIMENTS

The establishment of calendars including so-called perpetual calendars has been an endeavor throughout the centuries. In modern times, the Gregorian calendar named after Pope Gregory XIII and effective as of Oct. 15, 1582, has been generally accepted by all major countries, however, the problem of determining, for instance, the day of the week for a given date, past, present or in the future still does not seem achievable without either lengthy calculations, numerous and bewildering tables or a combination thereof. What goes for the Gregorian calendar is equally true for its predecessor, the Julian calendar inaugurated 46 B.C. by Julius Caesar or for that matter for the Coptic, Zodiacal and especially for the lunar calendar, the latter being adhered to mostly by the Islamic world.

These shortcomings are essentially overcome by the instant invention by adopting certain principles which have neither been recognized nor mentioned by previous calendar systems.

Using the tables of this invention, minor calculations and certain rules, the day of the week of any date, B.C. or A.D. can be easily determined either by the Gregorian, Julian, Islamic, Coptic or Zodiacal calendars. The instant calendars also allow fixing the dates of movable feasts such as Easter if such feast days are related to the phases of the moon.

In accordance with this invention the determination of day/date relationship for solar calendars is based on the numbers 4, 7 and 28, i.e. centuries are dealt with in groups of four, years within decades are subjugated to the 28-rule, and months are treated with the 7-rule, as shall be further explained below.

There are certain other rules commonly known and of concern to anyone dealing with calendars, namely, leap years, i.e. in the Gregorian system wherein the month of February has 29 days; all years wherein the last two digits (including 04 and 08) are divisible by 4, are leap years, unless they are centesimal years: centesimal years not divisible by 400 without remainder, (e.g. 1800 and 1900) are not leap years whereas those which can be divided by 400 (e.g. 1600 and 2000) are indeed leap years.

Before explaining the method of this invention, a discussion of the Figures is in order:

FIG. 1 provides calendar information for dates after Christ's birth (i.e. A.D.). It has eight horizontal rows having various letters and numbers. FIG. 1 also has 40 columns of seven numbers (not counting the top row), and is subdivided into six sections, all separated by double lines, namely, A, B, C, D, ST, LP, HJ, ZO, CP and E, wherein sections A, B, C and D are considered the year sections since they serve to determine the key of the year (KOY) (i.e. The first day of the week of a given year). Section ST (in combination with section E) is the key of the month (KOM) section for the standard (non-leap) year; there are seven rows having 1, 2 or 3 month values (1–12). Section LP (in combination with section E). provides information necessary to determine the KOM for leap years. Section HJ (HJ stands for Hijrah) provides key of the month information in combination with section E in terms of the lunar calendar. Sections ZO and CP each in combination with section E provide KOM information for the Zodiacal and Coptic calendars, respectively, all in terms of the Gregorian system. Section E is considered the day of date (DOD) section.

FIG. 2 represents a table having four sections: F, G, I and J which are considered the KOY sections for dates B.C. (Gregorian system).

FIG. 3 provides key of the year information for the Julian calendar and carries sections L, N, P and Q. each having eight columns and eight rows wherein the left columns and top rows in each section are considered index portions. The data from FIG. 3 is used in combination with sections ST or LP as well as E, all of FIG. 1.

FIG. 4 greatly abbreviates the information of FIG. 1 sections A, B, C, D, ST, LP and E, and of FIG. 2, and it has three major sections: A.D., Center and B.C. wherein the Center consists of six rows and seven columns, wherein the first, i.e. uppermost row is for use in combination with B.C. dates (note full triangular arrow pointing to the left) the second row is for use with A.D. dates (note full triangular arrow pointing to the right) and rows 3–6 serve for A.D. and B.C. determinations. The A.D. and B.C. sections each contain a first century row with numbers reading 0, 1, 2 and 3, each heading a column of four values. Rows 3–6 of the Center section are applicable to A.D. and B.C. day of the week calculations. It should be noted that row 3 of the Center section represents B.C. leap years, and row six indicates A.D. leap years (note open triangular arrows).

FIG. 5 deals with data necessary to determine date information for the time after Hijrah according to the lunar calendar and it has four major sections: Y′, M, K and H, wherein section Y′ represents the year section having 12 columns carrying 8 numbers and one column having four numbers, all in consecutive fashion, making it a sequence of integers from 1 to 100. Some of the numbers are marked by indices such as asterisk (*), filled circle (•) or empty circle (°) corresponding to marked values under century index columns M, K and H, respectively.

FIG. 6 is constructed in similar manner as FIG. 5 except the year section is named $Y^2$ and the M, K and H column values differ from those of FIG. 5; it will be noted that the markings differ as well.

FIG. 7 represents the century notations under columns M, K and H, and certain adjustments values under columns T and U, wherein M denotes the first, fourth etc. up to the 19th century, K stands for the second, fifth, etc. up to the 20th century, and H heads the values for the third, sixth, etc. up to 21st century with adjustment values under column T ranging from 0 to +6 for dates after Hijrah and under column U from 0 to −6 for dates before Hijrah corresponding to the century values in the same row. It should be noted that from the year 2200 before and after Hijrah, all year, M, K, H index and adjustment values repeat themselves, i.e. the year 2200 before and after Hijrah has the same connotations as the first year before or after Hijrah. Leap years in the lunar calendar are readily recognized: if the difference between two consecutive M, K or H index values is four (4) then the lower of the two is not a leap year, and if such difference is 5, then the lower of the two years is a leap year.

FIG. 8 correlates day indices 1 through 7 with their respective names of days of the week.

In order to carry out the determination of the day of a week for a given date, and according to the Gregorian calendar A.D. the following steps may be undertaken:

1. Determine the century within which the date falls;
2. Divide the century value by 4 and determine the remainder which will be 0, 1, 2 or 3; note, if the remainder is 0 then it is a leap year unless it is a centesimal year not divisable by 400;
3. If the last two digits of the year read 28 or more, subtract therefrom 28 or multiples thereof and determine the remainder which may be an integer from 1 to 28 (=0). Or divide the last two digits of the year by 28. If the result is one (1) or greater, subtract the integer (1, 2, etc.) multiply the resultant fraction with 28 and retain such value, which will be an integer from 1 to 28 (=0). If such last two digits are less than 28, then such value, 0–27 should be treated as remainder;
4. In FIG. 1, sections A, B, C or D, seek in columns headed by the above letters the value retained from step 3;
5. In the same section as found in step 4 seek the value retained from step 2 as a heading;
6. Determine the intercept of the row found in step 4 with the column obtained from step 5; such intercept will provide a value from 1–7; this value is designated the key of the year (KOY) and is the index for the first day of the year chosen;
7. Refer to FIG. 8 in order to determine the day of the week represented by the index found (caution; in the United States and as indicated herein, Sunday is designated the first day of the week; in many other countries including those in Europe, the official week starts with Monday);
8. Proceed to FIG. 1 section ST (if a standard year) or section LP (if a leap year), and seek the number of the month of the date chosen (January=1, December=12) and pursue the same row to section E while depicting the KOY value in the top row of the same section E: the intercept of the month's row from section ST or LP with the KOY column provides the index for the first day of the month, i.e. the key of the month (KOM);

9. Subtract from the day of the date the value of 7 or multiples thereof (i.e. 14, 21 or 28) and save the remainder which should have a value of 1–7 (7=0) and represents the key of the day (KOD);
10. Using section E of FIG. 1, pursue the row equivalent to KOM and the column for the KOD (or vice versa): the intercept provides the index of the day for the particular date;
11. In FIG. 8, determine the day of week from the above obtained index.

EXAMPLE 1

Determine the day of the week for Mar. 8, 1988 A.D. (Gregorian calendar):

1. Century: 20;
2. 20/4=5, remainder=0, (88/4=22, no remainder, 1988 is a leap year);
3. 88−(3 times 28)=88−84, remainder=4

$$\text{or: } 88/28 = 3.14286$$

$$0.14286 \text{ times } 28 = 4;$$

4. In FIG. 1, in columns headed under A, B, C or D, the value from step 3 (=4) is found under the D heading;
5. In the same section, the value from step 2 (=0) is located as a column heading;
6. The intercept of the row of value 4 and the column under 0 reveals a KOY value of 6;
7. In FIG. 8, the index of 6 stands for Friday i.e. the first day of 1988 was a Friday;
8. FIG. 1 section LP indicates that March (month No. 3) [November (month No. 11) falls in the same row] is located in the 5th row which, when pursued horizontally to section E intercepts with the column of the KOY (6) at a KOM value of 3 (according to FIG. 8, the index of 3 stands for Tuesday, the first day of March;
9. Date of day=8; KOD=8−7=1;
10. FIG. 1 section E indicates that the intercept of the KOD (1) row and the KOM (3) column (or vice versa) is a value of 3 as the index of the day;
11. FIG. 8 indicates Tuesday having index of 3 Answer: Mar. 8, 1988 is a Tuesday;

EXAMPLE 2

Determine the day of the week of July 4, 1776.

1. 1776=18th century; 76/4=19, no remainder, therefore a leap year;
2. 18/4=4 plus remainder 2;

$$76/28 = 2.7143$$

$$0.7143 \times 28 = 20 \text{ (remainder)};$$

4–7. FIG. 1 section D reveals intercept for values 2 and 20 as being 2, the KOY, i.e. the first day of 1776 was a Monday;
8. LP section of FIG. 1 row of 7 (month of July) intercepts with column of 2 section E at a value of 2 (=KOM): first day of July was a Monday;
9. Date of day=4 (=KOD);
10. and 11 The KOM−KOD intercept in section E reads 5, i.e. according to FIG. 8 July 4, 1776 was a Thursday.

Finding out days of the week for dates B.C. within the Gregorian system can readily be achieved by proceeding as follows:

Steps 1.–3. as described above;
4. In FIG. 2 under columns designated F, G, I or J seek value from step 3;
5. In the same section as value was found in step 4, seek number obtained from step 2 (0, 1, 2, or 3);
6. Determine intercept of row of step 4 and column of step 5. The intercept provides the key of the year (KOY);

Proceed with steps 7.–11. as above.

EXAMPLE 3

Determine the day of the week of Mar. 15, 44 B.C. (Ides of March; Death of Julius Caesar).

1. The year 44 falls into the first century;
2. Division of 1 (for 1st century by 4) does not render a value of 1 or greater, the remainder is therefore 1;
3. 44−28=16; 44/4=11; no remainder: standard year;
4.–7. Section J of FIG. 2 reveals as intercept of row 16 and 1 a KOY value of 1;
8. ST section of FIG. 1: the row of 3 (No. of month) intercepts with column 1 in section E at a value of 5 (=KOM), i.e. the first day of March was a Wednesday;
9. 15 (number of date) minus (2×7) equals 2, remainder: 1 (=KOD);
10. and 11. In FIG. 1 section E intercept of the KOM (4) and KOD (1) discloses a value of 4, therefore according to FIG. 8, Mar. 15, 44 B.C. was a Wednesday.

Days of the week for dates B.C. or A.D. may also be determined by an abbreviated method which is based essentially on FIG. 4 data. These steps ought to be followed:

1. Determine century of date;
2. Divide century value by 4, save the remainder (0,1,2, or 3);
3. Subtract from last two digits of the year the value of 28 or multiples thereof, save the remainder (if the last two digits represent a number less than 28, they are the remainder;
4. Seek in Center section of FIG. 4 the number obtained from step 3;
5. Move up the column of step 4 to top row (for B.C. dates) or second row (for A.D. dates) and determine value listed;
6. Move horizontally from place obtained by step 4 either to left (for A.D. dates) or the right (for B.C. dates) until the column under the value obtained from step 2 has been reached;
7. Determine the values arrived at by steps 5 and 6 and add up the two numbers. If that value is greater than 7, then subtract 7 or multiples thereof and save the remainder. The resultant remainder value is the key of the year (KOY);
8. To the KOY value add the number of the date and subtract one (1);
9. Subtract from the result of step 8 a value of 7 or multiples thereof and save the remainder (if the value from step 8 is less than 7, then it is the remainder);
10. Seek in FIG. 1 section E the intercept of the column headed by the value from step 9 with the row of the number of the month found either in section ST or LP that value is the index for the day of the date;
11. From FIG. 8 determine the name of the week associated with the index.

EXAMPLE 4

Determine the day of the week for Mar. 8, 1988 A.D.

(Gregorian calendar) according to the abbreviated form:

1. Determine century index: 20/4=5, remainder=0 (leap year);
2. Divide last two digits of year by 28:

$$88/28 = 3.14286$$

$$0.14286 \times 28 = 4 \text{ (remainder);}$$

3. Seek the value 4 in the Center section of FIG. 4, and not only move up to the second (i.e. A.D.) row and observe value of 0, but also move to the left until the column headed by zero (0) in the A.D. section is reached: the value of 6 will be noted;
4. Add the two values obtained above: 6+0=6, which is KOY;
5. Add KOY plus date minus 1, i.e.

$$6 + 8 - 1 = 13$$

$$13 - 7 = 6;$$

6. In FIG. 1 section E, determination of intercept from value of step 5 (6) and of row of the number of the month (3) in the LP section reveals the index of the day of the date: 3;
7. FIG. 8 indicates 3 as the value for Tuesday, Mar. 8, 1988.

EXAMPLE 5

Determine the day of the week for Mar. 15, 44 B.C. according to the Gregorian calendar, abbreviated form:

1. The year 44 falls within the first century;
2. Division of 1 (for century) by 4 leaves a value less than 1, therefore remainder is 1 (century index);
3.

$$44/28 = 1.5714$$

$$0.5714 \times 28 = 16, \text{ remainder}$$

(or: 44−28=16); 44/4=11, therefore not a leap year;

4. Moving from 16 value (center section of FIG. 4) up to B.C. row and horizontally to B.C. section, column under 1 indicates intercept values of 6 and 2, respectively;
5. 6=2=8; 8−7=1 (=KOY);
6. KOY (1) plus date (15) minus 1=15;
7. 15−(2×7)=1;
8. In FIG. 1 the intercept of column under 1 (section E) with row of No. of month (3) from ST section provides the value of 4;
9. According to FIG. 8, Mar. 15, 44 B.C. was a Wednesday.

The Julian calendar was inaugurated by Julius Caesar in the year 46 B.C. and was in use until Oct. 4, 1582 when it was replaced by the Gregorian calendar. It should be noted that every year divisible by four (4) is a leap year.

In accordance with this invention days of the week of any date A.D. or B.C. can readily be determined using FIG. 3 in combination with sections ST, LP and E of FIG. 1 by following these steps:

1. Determine the century of the date and subtract therefrom 7 or multiples thereof, saving the remainder which is an integer of from 0–6;
2. Subtract from the last two digits of the year a value of 28 or multiples thereof and save the remainder which should be an integer from 0 (=28) to 27. If the last two digits of that year have a value of less than 28, then they are the remainder.
3. In FIG. 3 columns L, N, P or Q seek the value obtained from step 2 and proceed horizontally to the right within the same section until interception is reached with the column headed by the number obtained by step 1: the value listed at that point is the key of the year and should be an integer from 1 to 7;
4. In FIG. 1 sections ST or LP (depending on whether it is a standard year or a leap year) seek the No. of the month and proceed to the right into section E until the column is reached which is headed by the value obtained from step 3. The intercept provides the key of the year (KOY).
5. Subtract from the day of the date a value of 7 or multiples thereof and save the remainder.
6. In FIG. 1 section E find the intercept of the column headed by the value of step 5 and the row starting with the value obtained from step 4. The resultant number is the index of the day.
7. Determine from FIG. 8 the day of the week corresponding to the index number of step 6.

EXAMPLE 6

Determine the day of the week for Oct. 4, 1582, the day when the Julian calendar was terminated in many countries in favor of the Gregorian calendar:

1.

$$1582 = \text{16th century;}$$

$$16/4 = 4; \text{ remainder} = 0;$$

2. 82/4=20, remainder 2, therefore not a leap year.

$$82/28 = 2.92857$$

$$0.92857 \times 28 = 26 = \text{remainder;}$$

3. In FIG. 3: row of 26 (section N) intercepts with column headed by 0 (see step 1) at a value of 6;
4. In FIG. 1 section ST seek value for No. of month (10), found in first row, and find intercept in section E with column headed by 6; intercept is 6;
5. Determination in section E of intercept of column headed by 4 (date of day) and of row starting with 6 reveals the value 2;
6. In FIG. 8, a value of 2 means Monday.

EXAMPLE 7

Determine the day of the week of Mar. 15, 44 B.C. according to the Julian calendar:

1. First century, not divisible by 4, therefore: remainder=1;
2. 44−28=16 (=remainder); 44/4=11 remainder 0; a leap year;
3. In FIG. 3 section Q seek row of 16 and column of 1 (from step 1): their intercept reveals a value of 4, the KOY;
4. In FIG. 1 section LP: seek No. of month (3) and determine intercept with column under 4 (KOY), result=1 (KOM);
5. 15−(2×7)=1;
6. In FIG. 1 section E the "1" column intercepts the "1" row at a value of 1;
7. FIG. 8 discloses: 1 represents Sunday.

9. Subtract from the day of the date the value of 7 or multiples thereof (i.e. 14, 21 or 28) and save the remainder which should have a value of 1–7 (7=0) and represents the key of the day (KOD);
10. Using section E of FIG. 1, pursue the row equivalent to KOM and the column for the KOD (or vice versa): the intercept provides the index of the day for the particular date;
11. In FIG. 8, determine the day of week from the above obtained index.

EXAMPLE 1

Determine the day of the week for Mar. 8, 1988 A.D. (Gregorian calendar):

1. Century: 20;
2. 20/4=5, remainder=0, (88/4=22, no remainder, 1988 is a leap year);
3. 88−(3 times 28)=88−84, remainder=4

$$\text{or: } 88/28 = 3.14286$$

$$0.14286 \text{ times } 28 = 4;$$

4. In FIG. 1, in columns headed under A, B, C or D, the value from step 3 (=4) is found under the D heading;
5. In the same section, the value from step 2 (=0) is located as a column heading;
6. The intercept of the row of value 4 and the column under 0 reveals a KOY value of 6;
7. In FIG. 8, the index of 6 stands for Friday i.e. the first day of 1988 was a Friday;
8. FIG. 1 section LP indicates that March (month No. 3) [November (month No. 11) falls in the same row] is located in the 5th row which, when pursued horizontally to section E intercepts with the column of the KOY (6) at a KOM value of 3 (according to FIG. 8, the index of 3 stands for Tuesday, the first day of March;
9. Date of day=8; KOD=8−7=1;
10. FIG. 1 section E indicates that the intercept of the KOD (1) row and the KOM (3) column (or vice versa) is a value of 3 as the index of the day;
11. FIG. 8 indicates Tuesday having index of 3 Answer: Mar. 8, 1988 is a Tuesday;

EXAMPLE 2

Determine the day of the week of July 4, 1776.

1. 1776=18th century; 76/4=19, no remainder, therefore a leap year;
2. 18/4=4 plus remainder 2;

$$76/28 = 2.7143$$

$$0.7143 \times 28 = 20 \text{ (remainder)};$$

4–7. FIG. 1 section D reveals intercept for values 2 and 20 as being 2, the KOY, i.e. the first day of 1776 was a Monday;
8. LP section of FIG. 1 row of 7 (month of July) intercepts with column of 2 section E at a value of 2 (=KOM): first day of July was a Monday;
9. Date of day=4 (=KOD);
10. and 11 The KOM−KOD intercept in section E reads 5, i.e. according to FIG. 8 July 4, 1776 was a Thursday.

Finding out days of the week for dates B.C. within the Gregorian system can readily be achieved by proceeding as follows:

Steps 1.–3. as described above;
4. In FIG. 2 under columns designated F, G, I or J seek value from step 3;
5. In the same section as value was found in step 4, seek number obtained from step 2 (0, 1, 2, or 3);
6. Determine intercept of row of step 4 and column of step 5. The intercept provides the key of the year (KOY);

Proceed with steps 7.–11. as above.

EXAMPLE 3

Determine the day of the week of Mar. 15, 44 B.C. (Ides of March; Death of Julius Caesar).

1. The year 44 falls into the first century;
2. Division of 1 (for 1st century by 4) does not render a value of 1 or greater, the remainder is therefore 1;
3. 44−28=16; 44/4=11; no remainder: standard year;
4.–7. Section J of FIG. 2 reveals as intercept of row 16 and 1 a KOY value of 1;
8. ST section of FIG. 1: the row of 3 (No. of month) intercepts with column 1 in section E at a value of 5 (=KOM), i.e. the first day of March was a Wednesday;
9. 15 (number of date) minus (2×7) equals 2, remainder: 1 (=KOD);
10. and 11. In FIG. 1 section E intercept of the KOM (4) and KOD (1) discloses a value of 4, therefore according to FIG. 8, Mar. 15, 44 B.C. was a Wednesday.

Days of the week for dates B.C. or A.D. may also be determined by an abbreviated method which is based essentially on FIG. 4 data. These steps ought to be followed:

1. Determine century of date;
2. Divide century value by 4, save the remainder (0,1,2, or 3);
3. Subtract from last two digits of the year the value of 28 or multiples thereof, save the remainder (if the last two digits represent a number less than 28, they are the remainder;
4. Seek in Center section of FIG. 4 the number obtained from step 3;
5. Move up the column of step 4 to top row (for B.C. dates) or second row (for A.D. dates) and determine value listed;
6. Move horizontally from place obtained by step 4 either to left (for A.D. dates) or the right (for B.C. dates) until the column under the value obtained from step 2 has been reached;
7. Determine the values arrived at by steps 5 and 6 and add up the two numbers. If that value is greater than 7, then subtract 7 or multiples thereof and save the remainder. The resultant remainder value is the key of the year (KOY);
8. To the KOY value add the number of the date and subtract one (1);
9. Subtract from the result of step 8 a value of 7 or multiples thereof and save the remainder (if the value from step 8 is less than 7, then it is the remainder);
10. Seek in FIG. 1 section E the intercept of the column headed by the value from step 9 with the row of the number of the month found either in section ST or LP that value is the index for the day of the date;
11. From FIG. 8 determine the name of the week associated with the index.

EXAMPLE 4

Determine the day of the week for Mar. 8, 1988 A.D.

(Gregorian calendar) according to the abbreviated form:

1. Determine century index: 20/4=5, remainder=0 (leap year);
2. Divide last two digits of year by 28:

$$88/28 = 3.14286$$

$$0.14286 \times 28 = 4 \text{ (remainder);}$$

3. Seek the value 4 in the Center section of FIG. 4, and not only move up to the second (i.e. A.D.) row and observe value of 0, but also move to the left until the column headed by zero (0) in the A.D. section is reached: the value of 6 will be noted;
4. Add the two values obtained above: 6+0=6, which is KOY;
5. Add KOY plus date minus 1, i.e.

$$6 + 8 - 1 = 13$$

$$13 - 7 = 6;$$

6. In FIG. 1 section E, determination of intercept from value of step 5 (6) and of row of the number of the month (3) in the LP section reveals the index of the day of the date: 3;
7. FIG. 8 indicates 3 as the value for Tuesday, Mar. 8, 1988.

EXAMPLE 5

Determine the day of the week for Mar. 15, 44 B.C. according to the Gregorian calendar, abbreviated form:

1. The year 44 falls within the first century;
2. Division of 1 (for century) by 4 leaves a value less than 1, therefore remainder is 1 (century index);
3.

$$44/28 = 1.5714$$

$$0.5714 \times 28 = 16, \text{ remainder}$$

(or: 44−28=16); 44/4=11, therefore not a leap year;

4. Moving from 16 value (center section of FIG. 4) up to B.C. row and horizontally to B.C. section, column under 1 indicates intercept values of 6 and 2, respectively;
5. 6=2=8; 8−7=1 (=KOY);
6. KOY (1) plus date (15) minus 1=15;
7. 15−(2×7)=1;
8. In FIG. 1 the intercept of column under 1 (section E) with row of No. of month (3) from ST section provides the value of 4;
9. According to FIG. 8, Mar. 15, 44 B.C. was a Wednesday.

The Julian calendar was inaugurated by Julius Caesar in the year 46 B.C. and was in use until Oct. 4, 1582 when it was replaced by the Gregorian calendar. It should be noted that every year divisible by four (4) is a leap year.

In accordance with this invention days of the week of any date A.D. or B.C. can readily be determined using FIG. 3 in combination with sections ST, LP and E of FIG. 1 by following these steps:

1. Determine the century of the date and subtract therefrom 7 or multiples thereof, saving the remainder which is an integer of from 0–6;
2. Subtract from the last two digits of the year a value of 28 or multiples thereof and save the remainder which should be an integer from 0 (=28) to 27. If the last two digits of that year have a value of less than 28, then they are the remainder.
3. In FIG. 3 columns L, N, P or Q seek the value obtained from step 2 and proceed horizontally to the right within the same section until interception is reached with the column headed by the number obtained by step 1: the value listed at that point is the key of the year and should be an integer from 1 to 7;
4. In FIG. 1 sections ST or LP (depending on whether it is a standard year or a leap year) seek the No. of the month and proceed to the right into section E until the column is reached which is headed by the value obtained from step 3. The intercept provides the key of the year (KOY).
5. Subtract from the day of the date a value of 7 or multiples thereof and save the remainder.
6. In FIG. 1 section E find the intercept of the column headed by the value of step 5 and the row starting with the value obtained from step 4. The resultant number is the index of the day.
7. Determine from FIG. 8 the day of the week corresponding to the index number of step 6.

EXAMPLE 6

Determine the day of the week for Oct. 4, 1582, the day when the Julian calendar was terminated in many countries in favor of the Gregorian calendar:

1.

$$1582 = \text{16th century;}$$

$$16/4 = 4; \text{ remainder} = 0;$$

2. 82/4=20, remainder 2, therefore not a leap year.

$$82/28 = 2.92857$$

$$0.92857 \times 28 = 26 = \text{remainder;}$$

3. In FIG. 3: row of 26 (section N) intercepts with column headed by 0 (see step 1) at a value of 6;
4. In FIG. 1 section ST seek value for No. of month (10), found in first row, and find intercept in section E with column headed by 6; intercept is 6;
5. Determination in section E of intercept of column headed by 4 (date of day) and of row starting with 6 reveals the value 2;
6. In FIG. 8, a value of 2 means Monday.

EXAMPLE 7

Determine the day of the week of Mar. 15, 44 B.C. according to the Julian calendar:

1. First century, not divisible by 4, therefore: remainder=1;
2. 44−28=16 (=remainder); 44/4=11 remainder 0; a leap year;
3. In FIG. 3 section Q seek row of 16 and column of 1 (from step 1): their intercept reveals a value of 4, the KOY;
4. In FIG. 1 section LP: seek No. of month (3) and determine intercept with column under 4 (KOY), result=1 (KOM);
5. 15−(2×7)=1;
6. In FIG. 1 section E the "1" column intercepts the "1" row at a value of 1;
7. FIG. 8 discloses: 1 represents Sunday.

It will be noted that the results of this example does not coincide with that of Example 3 due to differences in the two systems.

Both, the Zodiacal and Coptic calendars are based on the solar, not lunar cycles.

To determine days of the week in the Coptic system requires substantially the same steps as with the Gregorian calendar except that 283 years have to be added to the Coptic year in order to express the year in Gregorian terms, and, to the key of the year value of that Gregorian equivalent year a value of two (2) is added. Then one proceeds as outlined above using FIG. 1 sections A, B, C and D or FIG. 2 sections F, G, I and J all in combination with FIG. 1 sections CP and E and FIG. 8.

The Zodiacal evaluations require a similar approach, namely, to the Zodiac year of date are added 621 years, the key of the year of the resultant Gregorian year is determined and a value of two (2) is added thereto. From then on FIG. 1 (A, B, C, D, ZO and E) or FIG. 2 (F, G, I, J) plus FIG. 1 (ZO and E) as well as FIG. 8 may be used.

If in either of the above cases the final key of the year is greater than seven (7) then 7 or multiples thereof all subtracted therefrom and the remainder is used for further calculations as described above.

A large segment of the world's population adheres to the Islamic calendar which is based on lunar cycles (for descriptions of FIGS. 5, 6 and 7 see above).

Using the method of this invention, days of the week for given dates can be arrived at in a facile manner not previously known. It is suggested to proceed as follows:

1. Determine the century of the date;
2. Seek in FIG. 7 the century value which will determine whether to use column M, K or H in FIG. 5 or 6;
3. Note the last two digits of the year and seek such number in sections Y' (after Hijrah) or $Y^2$ (before Hijrah). Proceed in the row of the value to the right until interception is reached with the column indicated in step 2: if that column lists two numbers, then the one number carrying the identical mark as the year is chosen as the key of the year; if only one number is listed then that is the key of the year, and if the number carries a mark different from the year mark or no mark at all then that is the key of the year. It should be noted that the latter values represent a preliminary key of the year which may or may not become the actual key of the year as shall be explained in the steps below;
4. Using FIG. 7 seek century value and proceed to the right to column T (after Hijrah) or U (before Hijrah) in order to obtain the adjustment index;
5. Add the adjustment index to the preliminary KOY value; the resultant number represents the actual KOY;
6. In FIG. 1 section HJ seek the number of the month and proceed in the same row to section E until intercept with the column headed by the KOY number is reached. The number at the intercept is the key of the month;
7. Subtract a value of 7 or multiples thereof from the date number and save the remainder;
8. In section E of FIG. 1 select column headed by the KOM value and the row preceded by the remainder of step 7 in seek intercept which number represents the day of the week sought.

EXAMPLE 8

Determine the day of the week of the 20th day of the month of Rajab of the year 1408 (Islamic) [20-7-1408].

The above lunar date is equivalent to Tuesday, Mar. 8, 1988 A.D., Gregorian.

1. 1408 is within the 15th century;
2. Seek the number 15 in FIG. 7 which determines column H to be the appropriate one;
3. Following the row of 8 in Section Y' to column H reveals values 5 and 6°. Because 8 is also marked by an empty circle (°), 6 is the appropriate value (preliminary key of the year);
4. In FIG. 7 column H: the value of 15 (i.e. century) is associated in column T (after Hijrah) with a value of +4; therefore, $6+4-7=3$, the actual KOY;
5. In FIG. 1, column HJ the number of the month (7) is sought, and the intercept of its row with column 3 of section E is 5 (KOM);
6. $20-(2\times7)=6$=key of the day;
7. The intercept of column 5 (KOM) and row 6 of section E is 3;
8. FIG. 8 tells 3 to represent Tuesday.

The above mentioned system can be greatly be abbreviated by the method of this invention as indicated by FIG. 9. With the latter tabulation of only 40 numbers arranged in a certain fashion under the headings X, Y, Z, Y' and Z' in combination with FIG. 1 columns HJ and E.

These steps should be observed for determinations:

EXAMPLE 9

Determine the day of the week for the 20th day of Rajab (month no. 7) 1408 after Hijrah:

1. Subtract 840 or multiples thereof from the year: $1408-840=568$;
2. Divide the number obtained from step 1 by 120: the result should not be greater than 7, i.e. $568/120=4.7333$, integer=4 remainder: $0.7333\times120=88$;
3. Add one (1) to the integer of step 2, i.e. $4+1=5$, this is the index of the year; (if the calculation of step 2 does not result in a remainder, then nothing is added to the above integer);
4. Division of the remainder of step 2 by 8 leads to: $88/8=11$; remainder=0 (=8) (If there is obtained a remainder in this calculation, then the value of 1 shall have to be added to the above resultant integer);
5. The remainder of step 4 (8!) represents the value to be sought in column X of FIG. 9; in the latter table, the values of 1 in column Y as well as value of 1 in column Z are noted in the same row as 8. That number one (1) under Y represents the preliminary key of the year. The actual key of the year is obtained by subtracting from the preliminary key the index of the year minus one (1) (see step 3): $1-(5-1)$ may be written as $(1+7)-(5-1)=8-4=4$. Note: that value 4 is the final KOY if the integer of step 4 is equal or less than the value in the same row under Z. If the value of the integer is greater than the number in column Z then the value of one (1) must be subtracted from the actual KOY to become the final KOY;
6. In order to find the key of the day, add the final key of the year (3) to the number of the day (20) minus 1, i.e. $3+20-1=22$ -continued $$22 - (3 \times 7) = 1 \text{ (Guide number)};$$

7. In FIG. 1, section HJ seek number of month (7), proceed to right from 7 to section E, column headed by 1: the intercept reads 3;
8. FIG. 8 shows that a value of three means Tuesday. The latter day of the week in the same as obtained in Example 8.

Days of the week for dates before Hijrah may also be determined without difficulties using FIG. 9 in combination with FIG. 1 sections HJ and E as described in the following example.

EXAMPLE 10

Determine the day of the week for the 20th day of Rajab (month no. 7) 1408 before Hijrah:

1. 1408−840=568;
2.

$$568/120 = 4.7333; \text{ integer} = 4;$$
$$0.7333 \times 120 = 88 \text{ (remainder)}$$

3. 4+1=5 (index of year);
4. 88/8=11, remainder: 0 (=8);
5. In column X of FIG. 9 the value of 8 is associated with a value of 5 (the preliminary key of the year) in column Y′ and a value of 7 in column Z′.
6. Add 4 to the preliminary KOY and subtract 7 (5+4−7=2); the value of 2 is the actual KOY, and because the result in step 4 was greater than the number in column Z′, the value of one (1) is added to the actual KOY resulting in the final KOY of 3.
7. In FIG. 1 section HJ: row of 7 (No. of month) intercepts with column 3 of section E at a value of 5, the key of the month.
8. In section E the intercept of column 5 with row of number of date [20−(2×7)=6] reveals a value of 3.
9. In FIG. 8, the value of 3 means Tuesday, the day of the date.

The information provided by the instant invention may be represented in many other forms such as a circular, square or other arrangement or may be subjected to computerization.

What is claimed is:

1. A Perpetual calendar for determining the day of the week for a certain date comprising a plurality of interrelated tables including a first chart having ten sections of which the first 4 sections comprising seven rows indexed consecutively by integers from 1 to 28 and each having four columns headed by integers from 0 to 3, followed by five sections each having seven rows listing in predetermined order integers from 1 to 12 for certain five different calendar systems, and a table having integers from 1 to 7 arranged in a specific manner in seven rows and seven columns, a second table having four sections with seven rows consecutively indexed by integers of from 1 to 28 and each having four columns headed by integers from 0 to 4, a third table having four sections with seven consecutively indexed rows by integers of from 1 to 28 and seven columns headed by integers from 0 to 6, each such section presenting in rows and columns numbers arranged in a fashion suitable to determine calendar information, a fourth table having three sections, the first and third sections thereof each having four columns headed by integers from 0 to 4 and having four rows of integers from 1 to 7 arranged in a particular fashion, and a second section having a first row with integers from 0 to 6 arranged in a certain manner and affiliated with the third section, a second row having integers from 0 to 6 arranged in another fashion, and four rows of integers of 1 to 28 arranged in a lateral and consecutive manner, a fifth and sixth table each having four sections, the first section having eight rows listing integers from 1 to 100 in a consecutive and vertical manner, followed by three sections each having six rows and displaying two sets of integers from 1 to 7 in a peculiar manner, a seventh table having a first set of three columns together displaying integers from 1 to 21 in a consecutive manner, and a second set of two columns the first of which carrying consecutively the value 0 and positive integers from 1 to 6, and the second of which displaying consecutively the value 0 and negative integers from 1 to 6; and an eighth table having a first column carrying integers from 1 to 7 and a second column displaying the says of the week; and a ninth table having three columns wherein the first column displays integers from 1 to 8 consecutively, the second column displays integers from 1 to 7 in a non-consecutive order, and the third column carries non-sequential integers ranging from 1 to 15 in a non-consecutive manner; wherein said first four sections of the first table, the second, third, fourth, seventh and ninth table relate to the fifth, sixth, seventh, eighth, ninth and tenth section of the first table, the fifth and sixth table are correlated with the seventh table, and the tenth section of table 1 is correlated with the eighth table.

(a) providing the tables of claim 1,
(b) determine the key of the year,
(c) determine the key of the month using in combination the key of the year and the number of the month,
(d) determine the key of the day of week using in combination the key of the month and the number of the day, and
(e) translate the key of the day into the name of the day.

2. The method of claim 1 being used for the Gregorian, Julian, Islamic, Coptic and Zodiacal calendars.

3. A method for determining days of the week for certain dates comprising the steps:

4. The perpetual calendar of claim 3 wherein the tables are useful for specific calendar determinations including a first table for the Gregorian A.D. Coptic and Zodiacal calendars, a second table for the Gregorian B.C. calendar, a third table for the Julian calendar, a fourth table for the Gregorian calendar A.D. and B.C., a fifth table for the Islamic calendar after Hijrah, a sixth table for the Islamic calendar before Hijrah, a seventh table for the Islamic calendar before and after Hijrah, all in combination with certain sections of the first table.

* * * * *